US006656278B2

(12) United States Patent
Baisch

(10) Patent No.: US 6,656,278 B2
(45) Date of Patent: Dec. 2, 2003

(54) DOOR POSITIONING ARTICLE

(76) Inventor: Howard Baisch, 3541 23 Mile Rd., Shelby Township, MI (US) 48316

( * ) Notice: Subject to any disclaimer, the term of this patent is extended or adjusted under 35 U.S.C. 154(b) by 18 days.

(21) Appl. No.: 09/910,965

(22) Filed: Jul. 23, 2001

(65) Prior Publication Data

US 2003/0015135 A1 Jan. 23, 2003

(51) Int. Cl.[7] ..... B05C 13/00

(52) U.S. Cl. ..... 118/500; 118/503; 427/300; 269/315

(58) Field of Search ..... 118/500, 503; 29/460; 16/225, 255, 256, 297, 86 B, 85; 427/300, 401; 269/315–320; 24/570, 455, 545

(56) References Cited

U.S. PATENT DOCUMENTS 769,201 A * 9/1904 Blarcom et al. ..... 16/286
845,344 A * 2/1907 Gallinger ..... 16/72
5,582,446 A * 12/1996 Walker, Jr. ..... 292/288
5,675,865 A * 10/1997 van der Steur ..... 16/374
6,086,958 A * 7/2000 Russell et al. ..... 427/385.5
6,248,172 B1 * 6/2001 Shirotani et al. ..... 118/500
6,360,407 B1 * 3/2002 Webster et al. ..... 24/455

* cited by examiner

*Primary Examiner*—Richard Crispino
*Assistant Examiner*—Michelle A Lazor
(74) *Attorney, Agent, or Firm*—Clark Hill PLC

(57) ABSTRACT

A door positioning article positions a door of a motor vehicle in an ajar position with respect to the motor vehicle during coating steps of manufacture. The door positioning article includes a base. An extension is secured to the base for fastening the door positioning article to the motor vehicle. A retainer extends out from the base and holds the door in the ajar position with respect to the motor vehicle and the door positioning article. A spring extends between the base and the retainer for allowing the door to pass over the retainer and for forcing the retainer through an orifice in the door providing the defined ajar position.

18 Claims, 3 Drawing Sheets

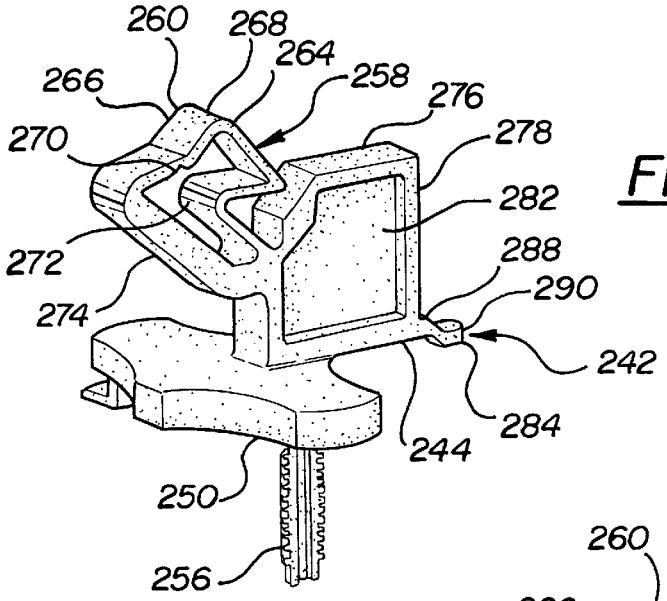
FIG-7
FIG-8
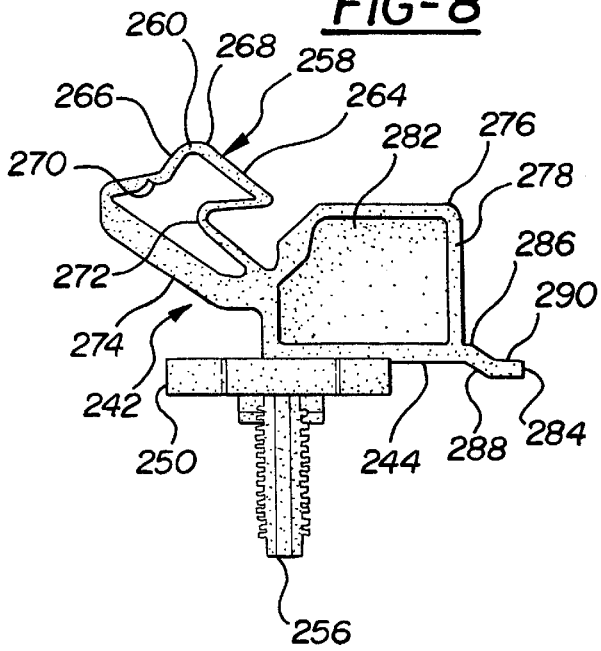
FIG-9
PRIOR ART
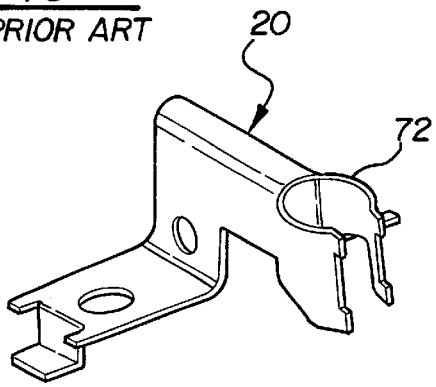
FIG-10
PRIOR ART
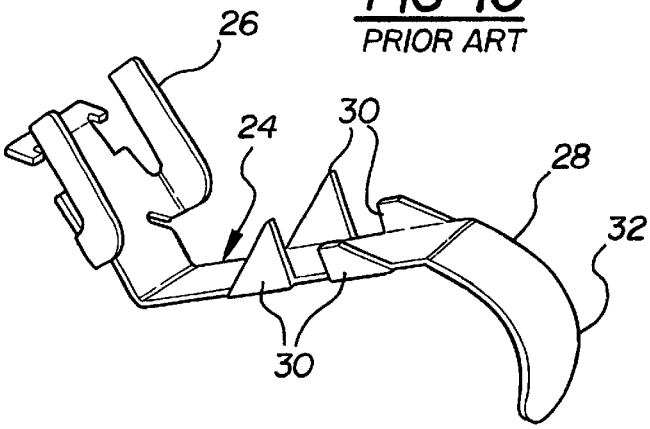

DOOR POSITIONING ARTICLE

BACKGROUND ART

1. Field of the Invention

The invention relates to an article used in the manufacture of assemblies. More specifically, the invention relates to an article used to maintain a component of an assembly in a position with respect to the remainder of the assembly during surface treatment processes of a manufacturing process.

2. Description of the Related Art

Complex assemblies often have components that have surfaces that need to be treated at some point in the manufacturing process. Treating or coating these surfaces require decisions on how and when in the manufacturing process this is to occur.

The decision of how and when to treat and/or coat ("coated") assemblies increases in complexity when components of the assembly are designed to move with respect to each other. An example of such an assembly is a motor vehicle. The doors of the motor vehicle must be coated in a similar manner as the body of the motor vehicle. To ensure they look the same, i.e., they are painted the same, the two components should be coated at the same time.

Because the best way to ensure the door and body of a motor vehicle are coated the same way is to do them at the same time, a decision must be made with regard to assembly. More specifically, a decision must be made as to whether the doors are to be secured to the body after the coating process has cured or before the coating portion of the manufacturing process has begun.

If the doors are to be secured to the body after the components are treated, the process may damage the coatings that were already applied to the components. If the door is secured before, the coating on the door may bond to the coating on the body resulting in either an immovable door or a door and a body with a flawed coating and surface.

A resolution to this matter has typically included the step of coating the door and the body of the motor vehicle after the door is secured to the body. Referring to FIG. 9, one embodiment of a door positioning article of the prior art is shown at 20. This embodiment 20 is fabricated from sheet metal so it is abrasive. The embodiment 20 includes a catch 22 that receives a striker from a door (neither shown) therein. This embodiment 20 requires the striker to be assembled prior to coating. This may increase the costs associated therewith because strikers typically are not coated.

A second embodiment of the prior art is shown at 24 in FIG. 10. The second embodiment 24 includes a securing end 26 for securing the second embodiment 24 to the body of the motor vehicle. A door is slid over a distal end 28 and secured in place with stops 30. A handle 32 is pushed downwardly to release the door from the second embodiment 24, which is subsequently forced off the body of the motor vehicle with a quick downward force applied thereto. The second embodiment 24 requires a sheet metal configuration. This material requirement and design promotes faults in the coatings of both the body and the door. More specifically, forcing the second embodiment 24 into and out of position creates unsightly and highly visible marks that compromise the integrity of the coating by allowing contaminants to reach the material being coated.

SUMMARY OF THE INVENTION

A door positioning article positions a door of a motor vehicle in an ajar position with respect to the motor vehicle.

The door positioning article is used during coating processes for the door and the motor vehicle. The door positioning article includes a base defining a longitudinal axis. An extension is secured to the base for fastening the door positioning article to the motor vehicle. A retainer extends out from the base and holds the door in the ajar position with respect to the motor vehicle and the door positioning article. A spring extends between the base and the retainer for allowing the door to pass over the retainer and for forcing the retainer through an orifice in the door providing the defined ajar position.

BRIEF DESCRIPTION OF THE DRAWINGS

Advantages of the invention will be readily appreciated as the same becomes better understood by reference to the following detailed description when considered in connection with the accompanying drawings, wherein:

FIG. 7 is a perspective view of a third embodiment of the invention;

FIG. 8 is a side view of the third embodiment of the invention;

FIG. 9 is a perspective view of one embodiment of a door positioning article of the prior art; and FIG. 10 is a second embodiment of a door positioning article of the prior art.

DETAILED DESCRIPTION OF THE PREFERRED EMBODIMENT

Figure 1:
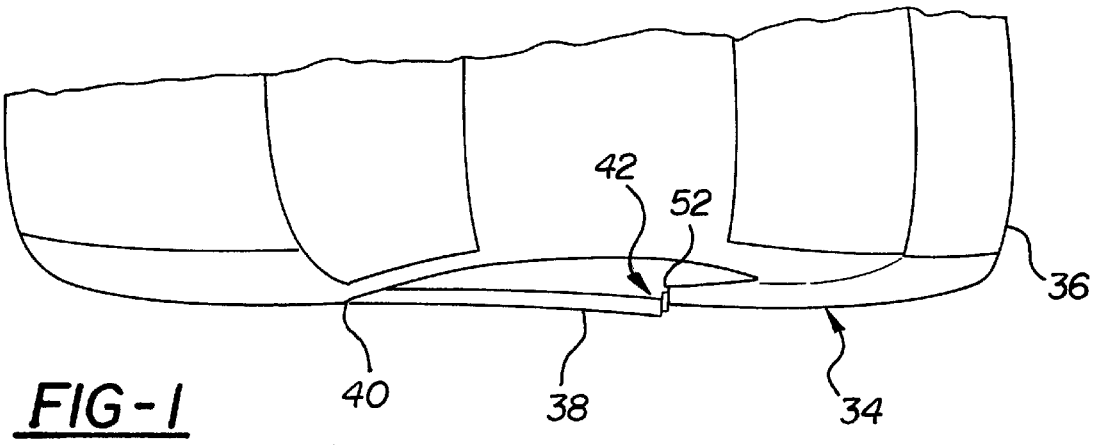
FIG. 1 is a top view, partially cut away, of a motor vehicle with a door retained in a desired position using one embodiment of the invention.

FIGS. 1 through 8 illustrate several embodiments of the invention. Elements that are similar throughout the Figures will have similar reference characters offset by one hundred. To the extent the elements are similar between embodiments, the description for each element will not be repeated.

Referring to FIG. 1, a portion of a motor vehicle 34 is shown. The motor vehicle 34 includes a body 36 and a door 38. The door 38 pivots about a door hinge (not shown) disposed adjacent a hinge end 40 of the door 38. As is shown in FIG. 1, the door 38 is in an ajar position because it is open with respect to the body 36 of the motor vehicle 34.

The invention, a door positioning article, is generally indicated at 42 in the Figures. The door positioning article 42 maintains the door 38 in the ajar position as is indicated in FIG. 1. The door positioning article 42 is fabricated from a thermoset polymer. The material chosen is one that can maintain its shape and integrity during the coating process, which includes curing steps in ovens at high temperatures.

Figure 3:
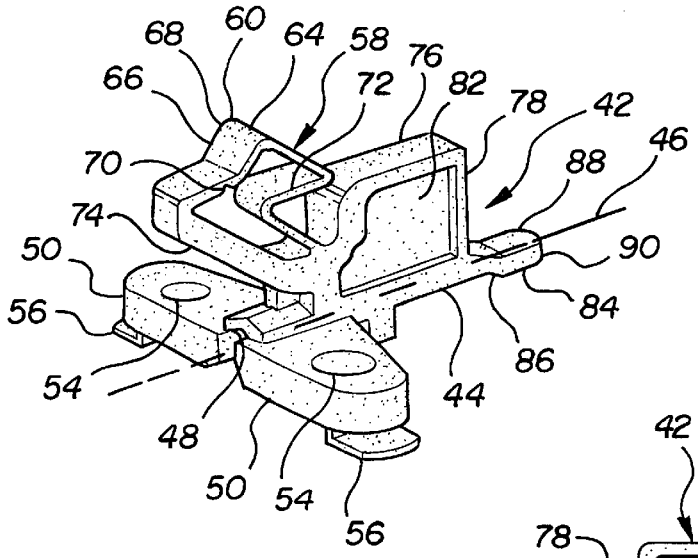
FIG. 3 is a perspective view of one embodiment of the invention.
Figure 4:
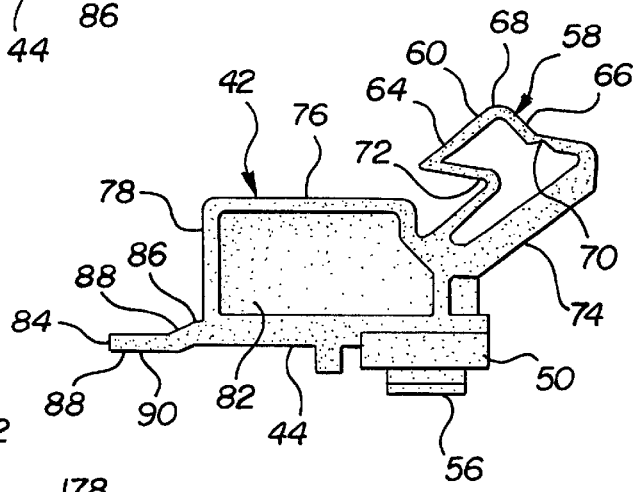
FIG. 4 is a side view of one embodiment of the invention.
Figure 5:
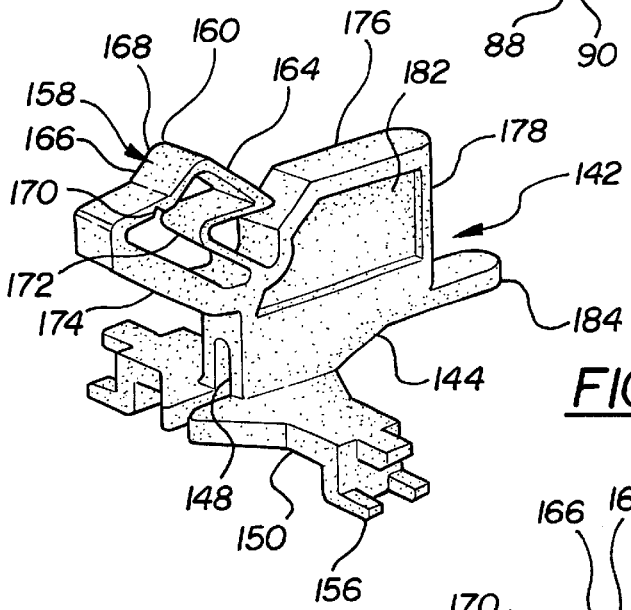
FIG. 5 is a perspective view of a second embodiment of the invention.
Figure 6:
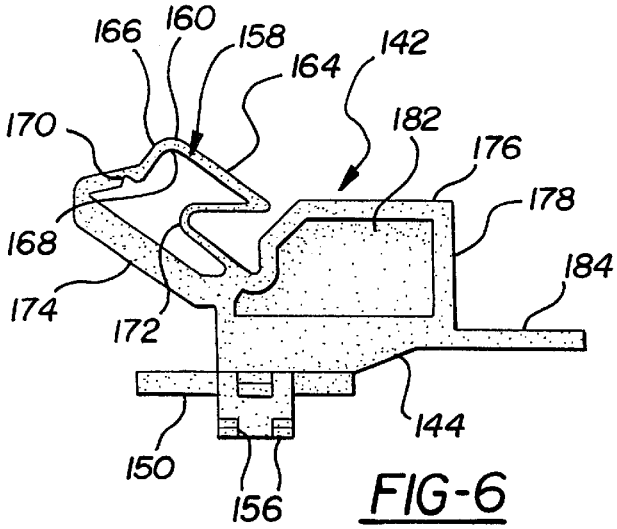
FIG. 6 is a side view of the second embodiment of the invention.

The door positioning article 42 includes a base 44 that defines a longitudinal axis 46, shown in FIG. 3. The base 44 is longitudinal in character. The base 44 includes a channel 48 that extends through a portion of the base 44. While it should be appreciated that the channel 48 may extend through the entire base 44, the embodiments shown in the Figures show the channel 48 extending through only a portion thereof. For reasons to be discussed subsequently, the third embodiment 242 shown in FIGS. 7 and 8 have a base 244 that is void of having a channel.

An extension 50 extends out from the base 44. The extension 50 includes two halves that are bifurcated by the channel 48. The extensions 50 may be symmetrical. The design of the extension 50 is due in large part to the design of the motor vehicle 34 and, in particular, the side of the door jamb 52. When the door jamb 52 is designed to require a different or non-symmetric extension 50, a different or non-symmetric extension 50 will be incorporated into the invention 42.

The extension 50 may include a hole 54 extending therethrough. The hole 54 provides access to the space behind the extension 50. Oftentimes, the door positioning article 42 is secured to the door jamb 52 over a hole (not shown) in the door jamb 52 that exists to allow a striker bar to be mounted to the door jamb 52. Access is required for certain situations including, but not limited to, e-coating the inside surface of the sheet metal that is used to manufacture the door 38.

Extending down from the extension 50 is a securing projection 56. The securing projection 56 engages the doorjamb 52, typically through a hole. The configuration of the securing projection 56, 156, 256 varies with the configuration of the doorjamb 52 and the requirements dictated by the manufacturer of the motor vehicle 34. As may be seen in FIGS. 7 and 8, a Christmas tree styled protrusion 256 is required.

The door positioning article 42 includes a retainer 58 that extends out from the base 44. The retainer 58 holds the door 38 in its ajar position with respect to the motor vehicle 34 and the door positioning article 42. The ajar position is shown in FIG. 1.

Figure 2:
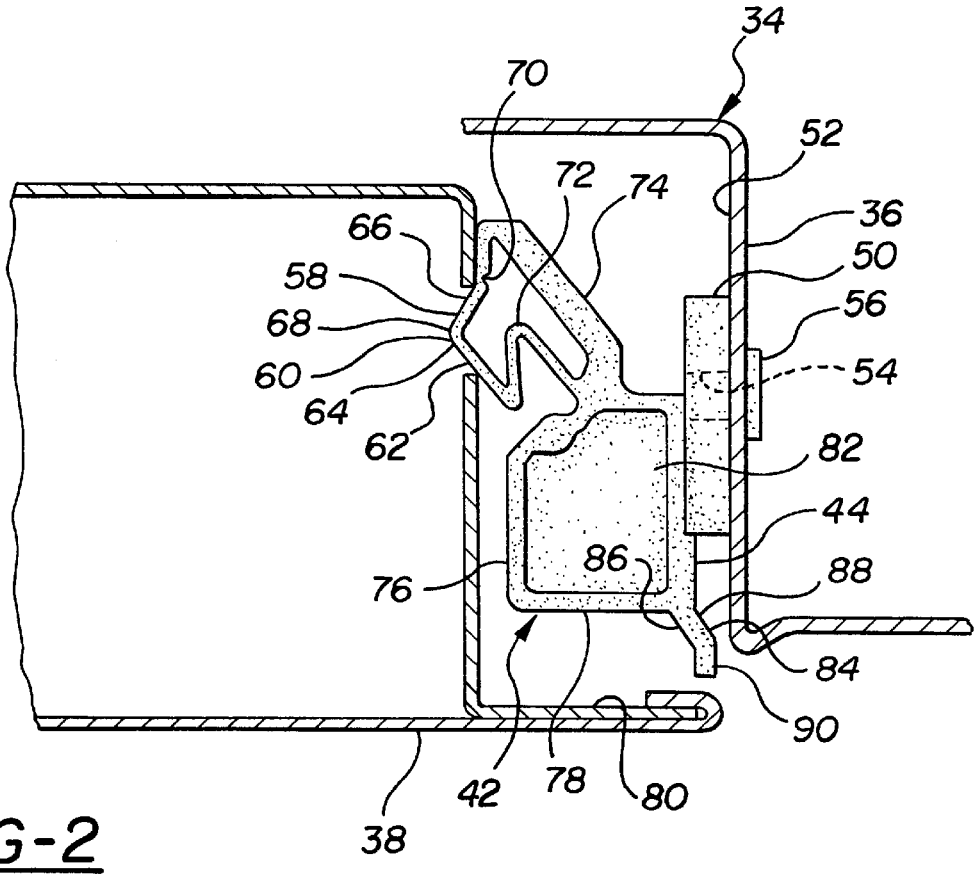
FIG. 2 is a top view of one embodiment of the invention shown in position with respect to a motor vehicle and door, both partially cut away.

The retainer 58 defines a protrusion 60. The protrusion 60 is designed to be received by a door hole 62 (FIG. 2). The protrusion 60 positively engages the door 38 by extending into the door hole 62. The protrusion includes two sides 64, 66 that create an apex 68. The two sided design is utilized in the preferred embodiment because it is bidirectional. More specifically, using two sides 64, 66 that form an apex 68 allow the door 38 to be moved over the protrusion 60 in both directions with the same amount of force required allowing the door 38 to be moved into and out of the ajar position.

The retainer 58 includes a hinge 70. The hinge 70 is at one end of one of the sides 66 opposite the apex 68 of the protrusion 60. The hinge 70 allows the retainer 58 to flex as the door 38 is moved into and out of the ajar position. The hinge 70 allows the retainer 58 to move closer to the base 44 as the door 38 passes thereby.

A spring 72 is fixedly secured to one end of the other of the sides 64 opposite the apex 68 of the protrusion 60. The spring 72 allows the retainer 58 to move back and forth as the door 38 moves into and out of the ajar position, the movement of which requires the door 38 to pass over the retainer 58.

A supporting member 74 extends between the base 44 and the retainer 58. The supporting member 74 extends upwardly from the base 44 at an angle. The supporting member 74 is secured to the retainer 58 at a position disposed adjacent the hinge 70. Together with the spring 72, the supporting member 74 holds the retainer 58 with respect to the base 44.

The door positioning article 42 also includes an overslam stop 76. The overslam stop 76 defines a stop surface 78 that prevents the door 38 from moving past the retainer 58. Therefore, when the door 38 is closed with excess force, e.g., when it is slammed shut, the stop surface 78 will prevent a door flange 80 (FIG. 2) from moving therepast which will, in turn, prevent the door hole 62 from moving past a position that will allow the protrusion 60 to engage the door hole 62. In the preferred embodiment, a solid wall 82 extends behind the stop surface 78 to provide additional support to the stop surface 78.

Extending out from the base 44 is a jam prevention leg 84. The jam prevention leg 84 includes three portions 86, 88, 90. A first portion 86 is to the base 44. A second portion 88 is secured to the first portion 86 and extends out therefrom at an angle askew thereto. A third portion 90 is secured to the second portion 88 and extends out therefrom at an angle askew thereto. In the embodiments shown in FIGS. 2–4, 7 and 8, the first 86 and third portions are parallel to each other. In the embodiment shown in FIGS. 5 and 6, the jam prevention leg 184 only includes a single portion that is flat. The jam prevention leg 84 prevents the door 38 from being jammed into the doorjamb 52 moving the door positioning article 42 out of alignment resulting in the misalignment of the protrusion 60 with respect to the door hole 62.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

I claim:

1. A door positioning article for positioning a door of a motor vehicle in an ajar position thereto during coating processes for the door and the motor vehicle, said door positioning article comprising:

a base defining a longitudinal axis;

an extension secured to said base extending perpendicularly out therefrom for fastening said door positioning article to the motor vehicle;

a retainer extending out from said base coplanar therewith for holding the door in the ajar position with respect to the motor vehicle and said door positioning article;

a supporting member extending between said base and said retainer to hold said retainer relative to said base; and a spring extending between said base and said retainer for allowing the door to pass over said retainer and for forcing said retainer through an orifice in the door providing the defined ajar position.

2. A door positioning article as set forth in claim 1 wherein said retainer includes a hinge allowing said retainer to move closer to said base as the door passes thereby.

3. A door positioning article as set forth in claim 2 including an overslam stop secured to said base preventing the door from being forced passed said door positioning article.

4. A door positioning article as set forth in claim 3 including a jam prevention leg extending out from said base to prevent the door from becoming locked in a position other than the ajar position.

5. A door positioning article as set forth in claim 4 wherein said retainer includes a protrusion for positive engagement wit the door.

6. A door positioning article as set forth in claim 5 wherein said jam prevention leg includes a first portion fixedly secured to said base and a second portion extending out from said first portion.

7. A door positioning article as set forth in claim 6 wherein said second portion is askew said first portion.

8. A door positioning article as set forth in claim 7 wherein said jam prevention leg includes a third portion askew said second portion and parallel to said first portion.

9. A door positioning article as set forth in claim 1 including a channel bifurcating said extension.

10. A door positioning article for positioning a door of a motor vehicle in an ajar position thereto during coating processes for the door and the motor vehicle, said door positioning article comprising:

a base defining a longitudinal axis;

an extension secured to said base extending perpendicularly out therefrom for fastening said door positioning article to the motor vehicle;

a retainer extending out from said base coplanar therewith for holding the door in the ajar position with respect to the motor vehicle and said door positioning article;

a supporting member extending between said base and said retainer;

a spring extending between said base and said retainer for allowing the door to pass over said retainer and for forcing said retainer trough an orifice in the door providing the defined ajar position; and an overslam stop secured to said base preventing the door from being forced passed said door positioning article.

11. A door positioning article as set forth in claim 10 wherein said retainer includes a hinge allowing said retainer to move closer to said base as the door passes thereby.

12. A door positioning article for positioning a door of a motor vehicle in an ajar position thereto during coating processes for the door and the motor vehicle, said door positioning article comprising:

a base defining a longitudinal axis;

an extension secured to said base extending perpendicularly out therefrom for fastening said door positioning article to the motor vehicle;

a retainer extending out from said base coplanar therewith for holding the door in the ajar position with respect to the motor vehicle and said door positioning article;

a supporting member extending between said base and said retainer;

a spring extending between said base and said retainer for allowing the door to pass over said retainer and for forcing said retainer through an orifice in the door providing the defined ajar position; and a jam prevention leg extending out from said base to prevent the door from becoming locked in a position other than the ajar position.

13. A door positioning article as set forth in claim 12 wherein said retainer includes a hinge allowing said retainer to move closer to said base as the door passes thereby.

14. A door positioning article as set forth in claim 13 including an overslam stop secured to said base preventing the door from being forced passed said door positioning article.

15. A door positioning article as set forth in claim 1 wherein said retainer includes a protrusion for positive engagement with the door.

16. A door positioning article as set forth in claim 15 wherein said jam prevention leg includes a first portion fixedly secured to said base and a second portion extending out from said first portion.

17. A door positioning article as set forth in claim 16 wherein said second portion is askew said first portion.

18. A door positioning article as set forth in claim 17 wherein said jam prevention leg includes a third portion askew said second portion and parallel to said first portion.

* * * * *

UNITED STATES PATENT AND TRADEMARK OFFICE

CERTIFICATE OF CORRECTION

PATENT NO. : 6,656,278 B2
DATED : December 2, 2003
INVENTOR(S) : Baisch

It is certified that error appears in the above-identified patent and that said Letters Patent is hereby corrected as shown below:

Column 4,
Line 67, delete “wit” and insert therefor -- with --.

Column 6,
Line 25, delete “claim 1” and insert therefor -- claim 14 --.

Signed and Sealed this

Thirtieth Day of March, 2004

JON W. DUDAS
*Acting Director of the United States Patent and Trademark Office*